US011965383B1

(12) United States Patent
Teodorescu

(10) Patent No.: US 11,965,383 B1
(45) Date of Patent: Apr. 23, 2024

(54) TRI-AXIAL SHOCK ABSORBER SUB

(71) Applicant: Stabil Drill Specialties, L.L.C., Lafayette, LA (US)

(72) Inventor: Sorin Gabriel Teodorescu, The Woodlands, TX (US)

(73) Assignee: Stabil Drill Specialties, LLC, Lafayette, LA (US)

( * ) Notice: Subject to any disclaimer, the term of this patent is extended or adjusted under 35 U.S.C. 154(b) by 648 days.

(21) Appl. No.: 17/148,117

(22) Filed: Jan. 13, 2021

Related U.S. Application Data

(60) Provisional application No. 62/966,295, filed on Jan. 27, 2020.

(51) Int. Cl.
*E21B 17/07* (2006.01)

(52) U.S. Cl.
CPC ..... *E21B 17/073* (2013.01)

(58) Field of Classification Search
CPC .... E21B 17/07; E21B 17/073; E21B 17/1014; E21B 17/1021; E21B 17/1078
See application file for complete search history.

(56) References Cited

U.S. PATENT DOCUMENTS 3,918,519 A * 11/1975 Cubberly, Jr. ..... E21B 47/18 166/212
4,194,582 A * 3/1980 Ostertag ..... E21B 17/07 267/71
4,630,809 A 12/1986 Duckworth
4,842,082 A * 6/1989 Springer ..... E21B 23/06 175/286
4,848,490 A * 7/1989 Anderson ..... E21B 17/1014 175/323
6,332,841 B1 12/2001 Secord
7,654,344 B2 2/2010 Haughom et al.
7,748,474 B2 7/2010 Watkins et al.
7,828,082 B2 11/2010 Pabon et al.
8,589,136 B2 11/2013 Ertas et al.
8,622,153 B2 1/2014 McLoughlin et al.
(Continued)

FOREIGN PATENT DOCUMENTS

WO 2014/146201 A1 9/2014
WO WO-2019232006 A1 * 12/2019 ..... E21B 12/00

OTHER PUBLICATIONS

"Active Vibration Damper Sub (AVD)" SureDrill-AVD technical data sheet, APS Technology, Inc., 2 pages.
(Continued)

*Primary Examiner* — D. Andrews
(74) *Attorney, Agent, or Firm* — Jones Walker LLP

(57) ABSTRACT

A downhole shock absorbing sub which includes a tubular main stem extending through a sub housing and a lateral shock absorbing assembly positioned within the sub housing. The lateral shock absorbing assembly includes an activator ring positioned around the main stem, the activator ring including a plurality of wedge inserts positioned around a perimeter of the activator ring. A reaction collar is positioned on each side of the activator ring with the reaction collars including ramp surfaces engaged by the wedge inserts. A spring system is positioned to resist movement of the reaction collars away from the activator ring, whereby lateral movement of the main stem causes the wedge inserts to move the reaction collars against the spring system.

17 Claims, 12 Drawing Sheets

(56) References Cited

U.S. PATENT DOCUMENTS

| | | | | |
|---|---|---|---|---|
| 8,944,190 | B2 | 2/2015 | Wassell et al. | |
| 9,109,410 | B2 | 8/2015 | Swietlik et al. | |
| 9,121,233 | B2 | 9/2015 | Prieto | |
| 9,376,874 | B2 | 6/2016 | Reimers | |
| 9,476,261 | B2 | 10/2016 | Venugopal et al. | |
| 9,512,684 | B2 | 12/2016 | Khaparde et al. | |
| 10,533,376 | B2 | 1/2020 | Reimers | |
| 2007/0000695 | A1 | 1/2007 | Laflin | |
| 2008/0060849 | A1 | 3/2008 | Entchev et al. | |
| 2009/0023502 | A1 | 1/2009 | Koger | |
| 2014/0262650 | A1 | 9/2014 | Eppink | |
| 2015/0083492 | A1 | 3/2015 | Wassell | |
| 2015/0083493 | A1 | 3/2015 | Wassell | |
| 2015/0122547 | A1 | 5/2015 | Hohl et al. | |
| 2015/0176344 | A1 | 6/2015 | McLoughlin et al. | |
| 2015/0376959 | A1 | 12/2015 | Dinica et al. | |
| 2017/0204684 | A1 | 7/2017 | Cravatte et al. | |
| 2017/0328142 | A1 | 11/2017 | Pratt et al. | |
| 2021/0087890 | A1* | 3/2021 | Dinica | F16F 13/007 |

OTHER PUBLICATIONS

"Downhole Shock Tool" retrieved from www.downhole.com/portofolio-items/down-hole-shock-tools/ on Jan. 15, 2018, 2 pages.

* cited by examiner

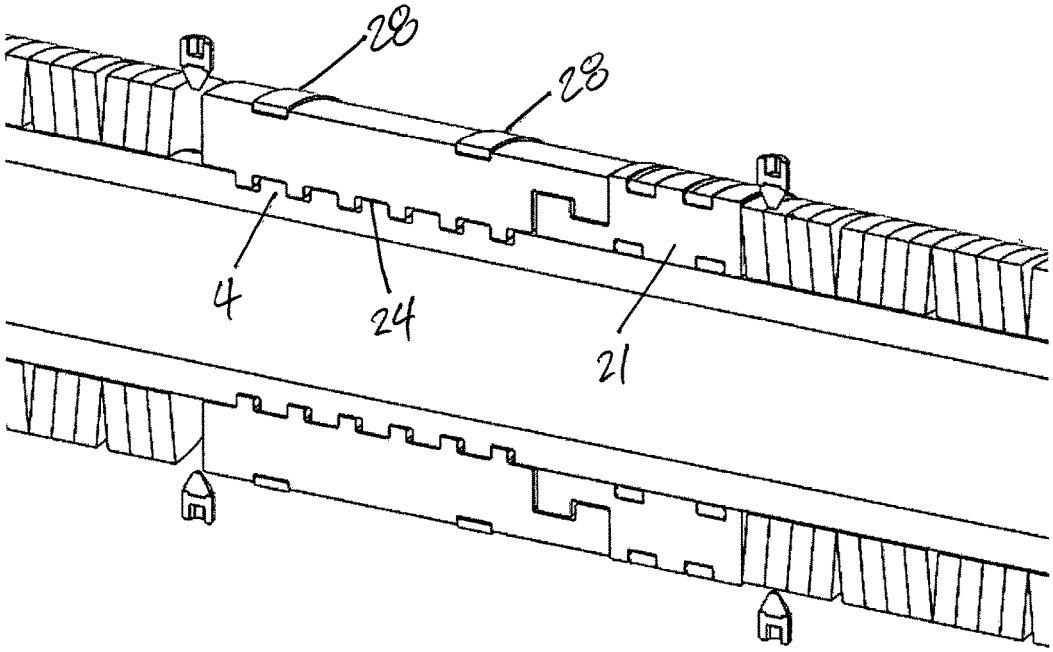
FIG. 5A
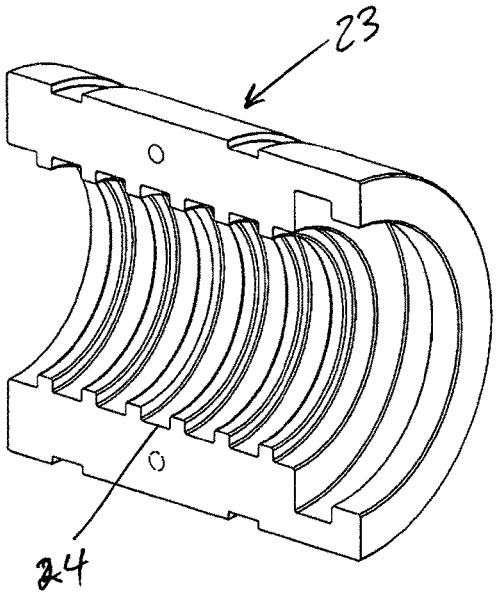
FIG. 5C
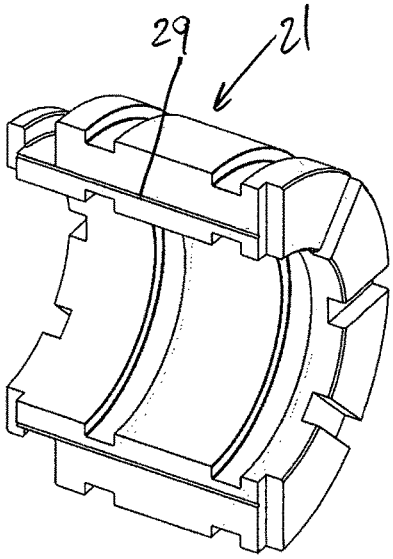
New FIG. 5B

Drilling-related spectral signatures (Macpherson et al. 2001).

TRI-AXIAL SHOCK ABSORBER SUB

This application claims priority under 35 USC § 119(e) to U.S. Ser. No. 62/966,295 filed Jan. 27, 2020, which is incorporated by reference herein in its entirety.

I. BACKGROUND

When drilling earthen wellbores, e.g., oil and gas wells, various sources excite or cause vibration in the drillstring. If the frequency of any of the excitation sources is a natural frequency of the drillstring (axial, torsional or lateral) then the string resonates. Vibration levels are generally highest at resonance, but high level vibrations may exist in the drillstring, independent of drillstring resonance, whenever a high level of excitation is present.

Drilling with large amplitude vibrations typically results in accelerated drillstring fatigue. Even in the absence of drillstring damage, high amplitude drillstring vibrations often represent a loss of drilling energy and lead to sub-optimum drill rates. The type and amplitude of vibrations varies greatly depending on equipment being used and the nature of the strata being drilled. Although many "dampening" tools exist for insertion within the drillstring in order to reduce vibration, these tools are often not effective in reducing vibrations in all dimensions and are not readily "tunable" to address the particular vibration modes of a particular drilling operation. A shock absorbing tool dampening vibration in multiple dimensions, and/or being more readily tunable, and/or dampening more efficiently, would be a desirable improvement in the industry.

II. SUMMARY OF SELECTED EMBODIMENTS

One embodiment is downhole shock absorbing sub which includes a tubular main stem extending through a sub housing and a lateral shock absorbing assembly positioned within the sub housing. The lateral shock absorbing assembly includes an activator ring positioned around the main stem, the activator ring including a plurality of wedge inserts positioned around a perimeter of the activator ring. A reaction collar is positioned on each side of the activator ring with the reaction collars including ramp surfaces engaged by the wedge inserts. A spring system is positioned to resist movement of the reaction collars away from the activator ring, whereby lateral movement of the main stem causes the wedge inserts to move the reaction collars against the spring system.

Another embodiment is the addition of a torsional shock absorbing assembly within the sub housing. The torsional shock absorbing assembly includes a first helix sleeve configured to rotate with the main stem, the first helix sleeve having a first helical cam surface formed on an end surface of the sleeve. A second helix sleeve is configured to translate relative to the main stem, the second helix sleeve having a second helical cam surface formed on an end surface of the sleeve and engaging the first helical cam surface. A spring system positioned to resist movement of the first and second helix sleeves away from one another; whereby rotational movement of the main stem causes the first and second helical cam surfaces to move (i) the first and second helix sleeves apart, and (ii) at least one of the first or second helix sleeves into engagement with the spring system.

A further embodiment is the addition of an axial shock absorbing assembly within the sub housing. The axial shock absorbing assembly includes a load collar fixed axially on the main stem. A spring system configured to resist axial movement of the load collar relative to the sub housing, while first and second seal collars are positioned to bracket the load collar and spring system between the seal collars, and thereby controlling the flow a fluid in which the load collar and spring system are immersed.

III. BRIEF DESCRIPTION OF THE DRAWINGS

FIG. 5A is a perspective sectional view of the load collar of the axial shock absorbing assembly.

FIG. 5B is a perspective view of a seal collar.

FIG. 5C is a perspective view of a load collar.

II. DETAILED DESCRIPTION OF SELECTED EMBODIMENTS

Figure 1A:
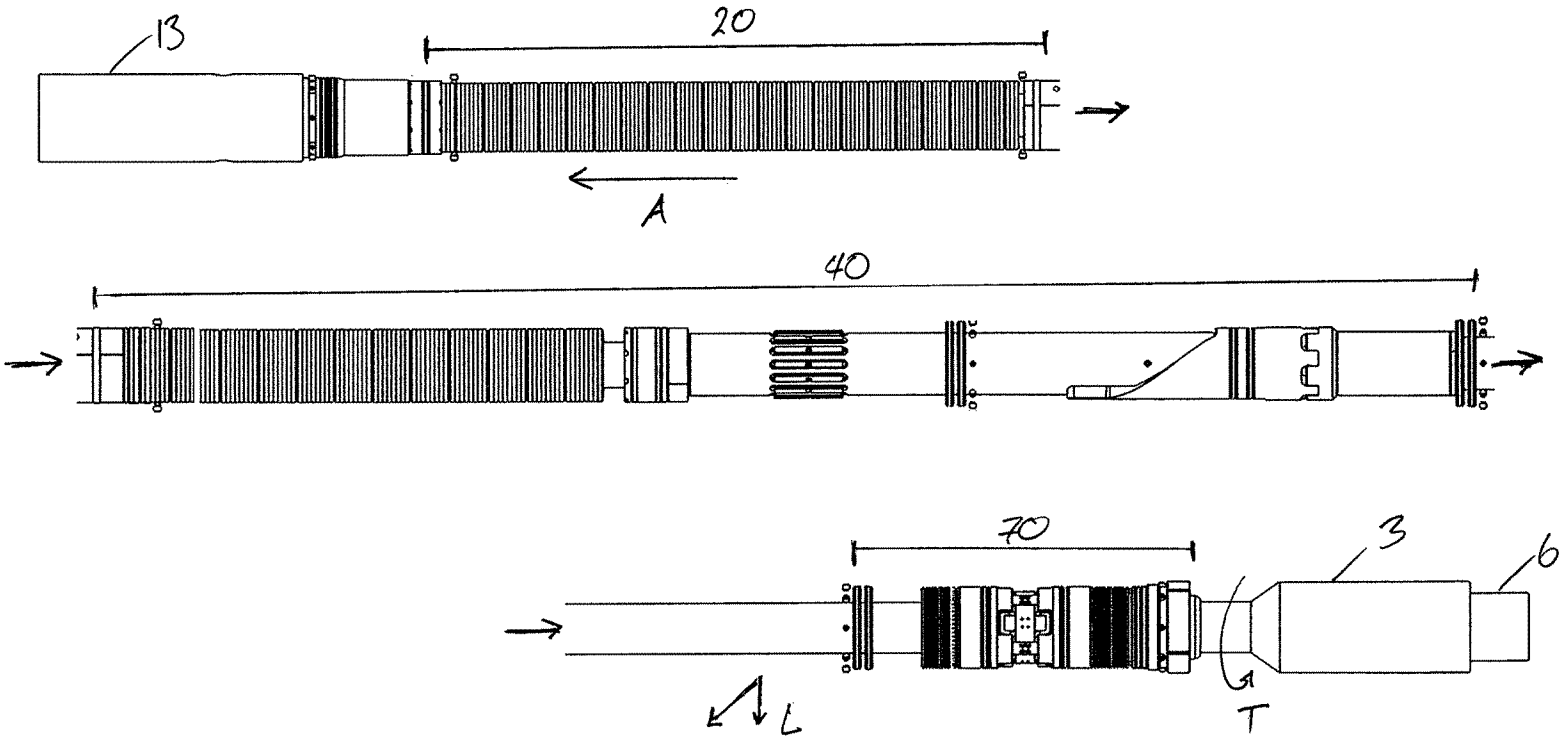
FIG. 1A is a planar view of the over-all shock absorber sub shown with the outer housing sections remove.
Figure 1C:
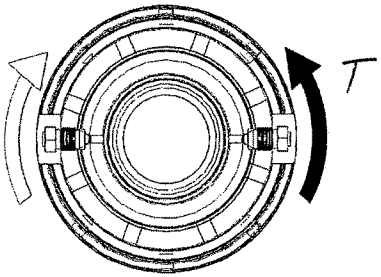
FIG. 1C is a cross-sectional view illustrating movement in the torsional direction.
Figure 1B:
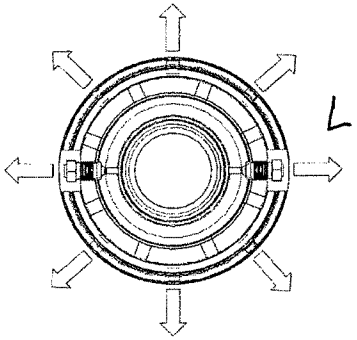
FIG. 1B is a cross-section view illustrating movement in the lateral direction.

FIG. 1A illustrates the primary functional assemblies of one embodiment of the multi-axial or multi-directional shock absorbing sub of the present invention. The shock absorbing sub may also sometimes be referred to as a multi-axial "dampening" sub. The multiple axes or directions referred to are generally at least two of (i) the "axial" direction which runs parallel to the long axis of the sub (see directional arrow A in FIG. 1A), (ii) the "lateral" direction generally defined by movement in the plane perpendicular the axial direction (see directional arrows L in FIGS. 1A and 1B), and (iii) the "torsional" direction defined as rotation around the long axis A (see the directional arrow T in FIGS. 1A and 1C). The below description generally discusses a tri-axial shock absorbing sub, but a bi-axial shock absorbing sub is discussed in connection with FIG. 13A.

Figure 2:
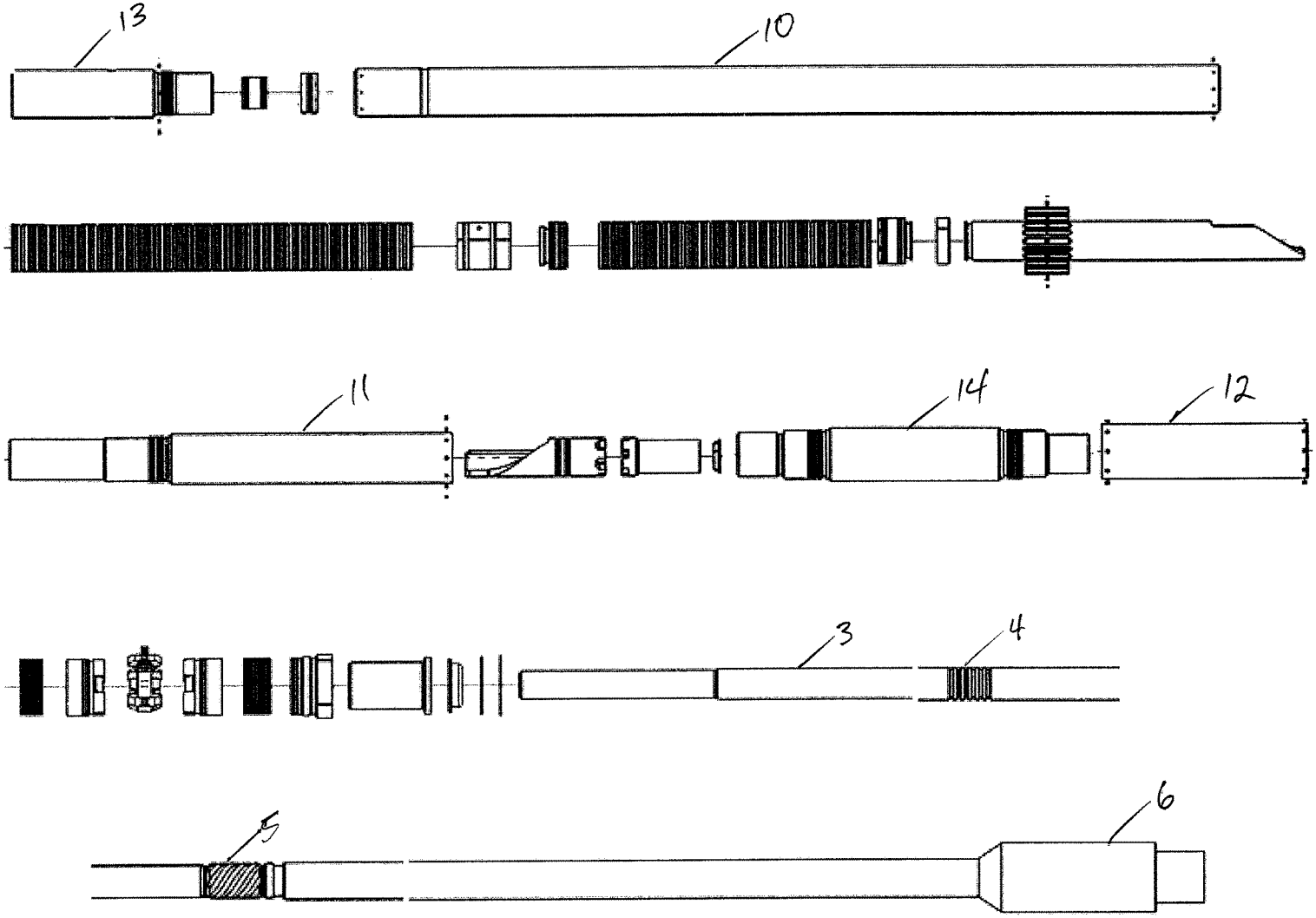
FIG. 2 is an exploded view of the over-all shock absorber sub.

The multi-axis shock absorbing sub 1 will largely be assembled on a tubular main stem 3 (more clearly seen in the exploded view of FIG. 2). Returning to FIG. 1A, multi-axis shock absorbing sub 1 can be divided into three primary functional assemblies, (i) axial absorber assembly 20, (ii) torsional absorber assembly 40, and (iii) lateral absorber assembly 70. Although FIG. 1A is illustrated with the outer covering sleeves of the multi-axis shock absorbing sub being removed in order to show internal components, FIG. 2 shows the main sleeve 10, torsional damping sleeve 11, lower spacing sleeve 14 and lateral damping sleeve 12, which generally form the outer housing of multi-axis shock absorbing sub 1. A pin threads connector sub 6 is formed on one end (the "lower" end) of main stem 3 and the box threads connector sub 13 engages main sleeve 10 on the other end ("upper" end) of the multi-axis shock absorbing sub. As used herein, the terms "above" or "upper" will generally mean in a direction toward the surface of the wellbore, while "below" or "lower" will generally mean toward the bottom of the wellbore, regardless of the actual orientation of the wellbore, e.g., a lateral or horizontal section of the wellbore.

Figure 3:
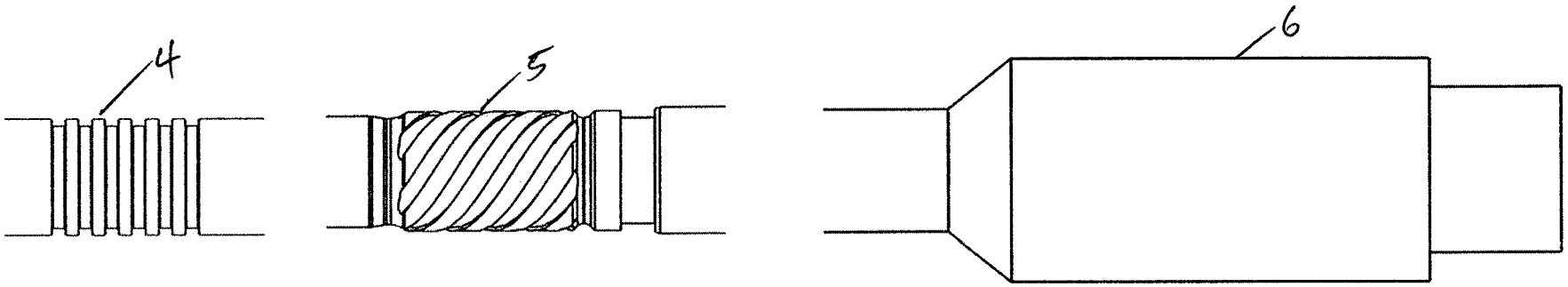
FIG. 3 is a partial view showing the primary features of the shock absorber main stem, including certain splines formed on the main stem.
Figure 9:
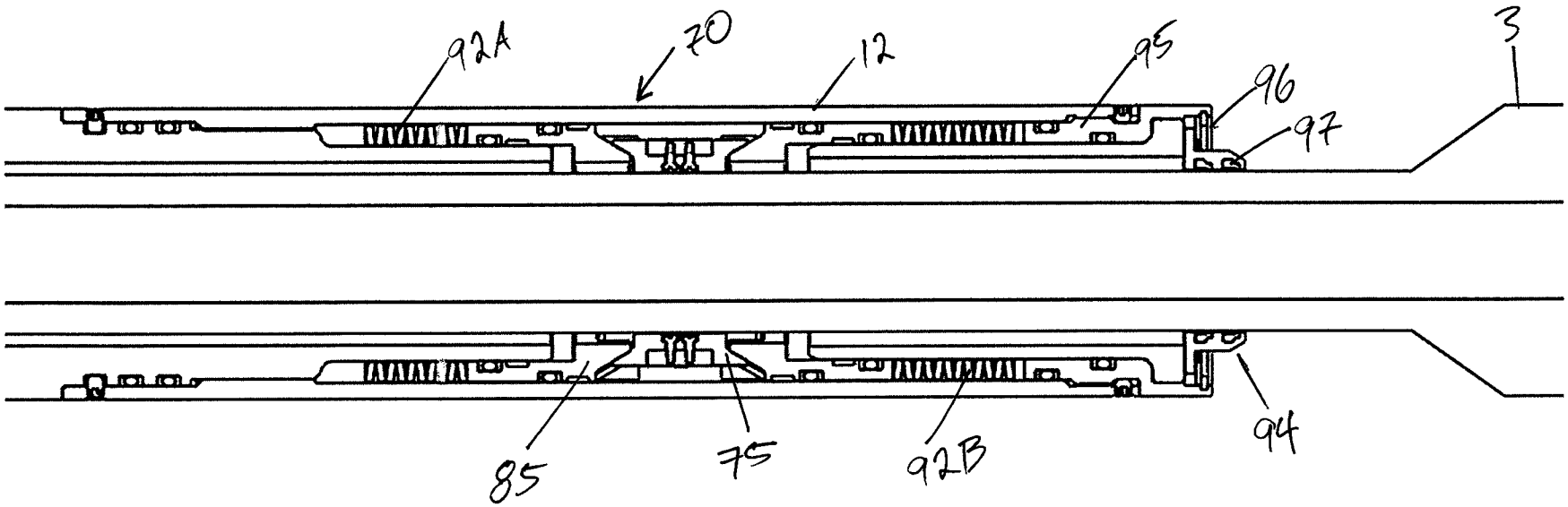
FIG. 9 is a cross-sectional view particularly showing the lateral shock absorbing assembly.

As seen in the cross-section views in FIGS. 4A, 6, and 9, main stem 3 extends through the three shock absorber sections (assemblies), but stops short of fully engaging upper internal shoulder 16 of the box threads sub 13 (seen in FIG. 4A) in order to allow for displacement when the springs described below are compressed. As explained in more detail below, the distance between the end of main stem 3 and internal shoulder 16 formed a space 7 in box threads sub 13 to allow main stem 3 to move further into the box threads sub 13 relative to main sleeve 10 and the other outer sleeves. As suggested in FIG. 3, main stem 3 will have different sets of splines formed along its length, in particular the circumferential splines 4 and the spiral or torsional splines 5.

Figure 4A:
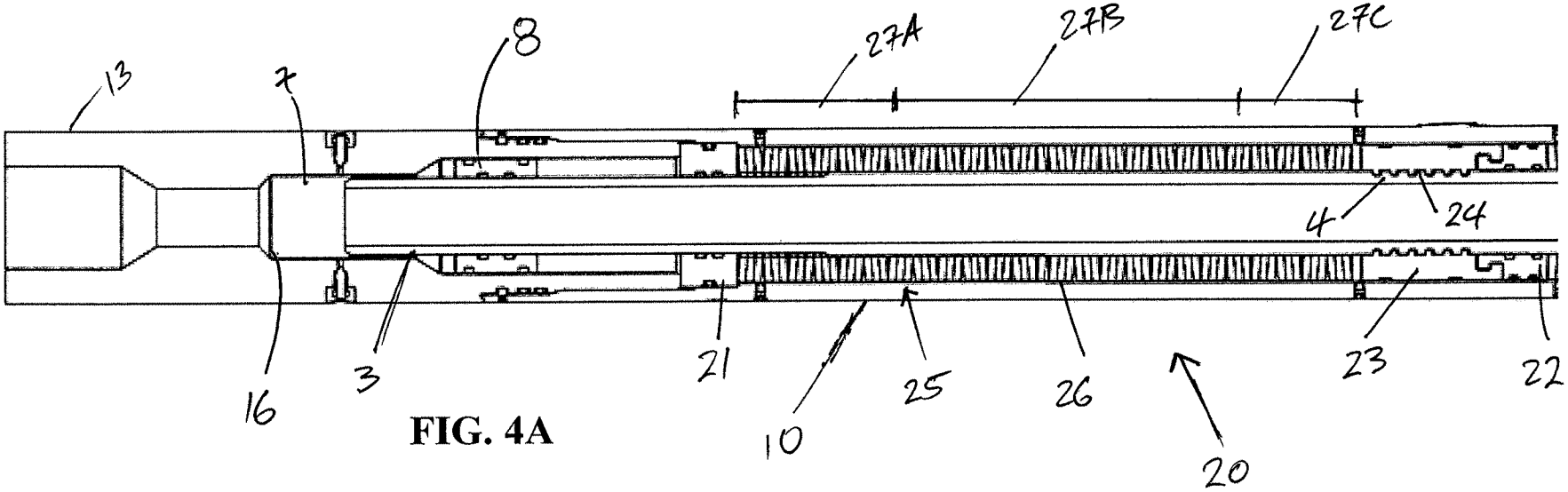
FIG. 4A is a cross-section view particularly showing the axial shock absorbing assembly.

Turning more specifically to the axial absorber assembly 20, this portion of the multi-axis shock absorbing sub is best seen in FIGS. 4A and 5A. It can be seen that the load collar 23 has a series of splines and grooves 24 which mate with the circumferential splines and grooves 4 on main stem 3. The engagement of splines and grooves 4 and 24 insure that load collar 23 and main stem 3 always move together in the axial direction. As seen in FIG. 5C, this embodiment of load collar 23 will be formed in two half sections so that it may be positioned on the spline and grooves 4 prior to main sleeve 10 being slid over the main stem and load collar. It will be apparent that load collar 23 is the primary component separating the axial and torsional sections or assemblies. As best seen in FIG. 5A, a pair of wear bands 28 encircle load collar 23 and serve to prevent the outer surface of load collar 23 and the inner surface of main sleeve 10 from abrading one another. Again viewing FIG. 4A, between load collar 23 and zone seal collar 22 on one end, and seal collar 21 on the other end, is positioned the spring bank 25. In the FIG. 4A embodiment, spring bank 25 is formed by a series of spring washers (i.e., Belleville washers) 26, but could also be another conventional or future developed biasing mechanism. Both seal collar 21 and zone seal collar 22 carry seals which act to prevent the flow of a hydraulic fluid past the edges of the seal collars. However, as suggested in FIG. 5B, zone seal collar 22 (and also seal collar 21 even if not explicitly illustrated) will also include a series of bleed apertures 29 which allow the comparatively slow flow of hydraulic fluid through the seal collars. Those skilled in the art will recognize the bleed apertures 29 will act to provide a hydraulic dampening effect (in addition to the mechanical dampening of spring banks 25) when fluid pressure is increased on one side of the seal collar relative to the other side. In one embodiment, the seal collars will have approximately 4 to 8 bleed apertures 29 with each aperture being anywhere between about 1 and 5 mm in diameter. Although the dampening fluid may flow though bleed apertures in seal collar 21, the end seal 8 (see FIG. 4A) prevents the dampening fluid from escaping into the space 7 and the central passage of main stem 3. It will also be understood that dampening fluid is able to flow around load collar 23 on its path to or from bleed apertures in zone seal collar 22.

As seen in FIG. 4A, seal collar 21 abuts against an inner threaded extension of box threads sub 13 and is thereby prevented from movement toward the box thread end of multi-axis shock absorbing sub 1. However, as described above, main stem 3 is capable of movement in that direction relative to main sleeve 10 and box threads sub 13. It will readily be seen that axial force on pin threads sub 6 acting in the direction toward box threads sub 13 (generally considered the "uphole" direction) will cause load collar 23 to act against the spring washers 26 in spring bank 25. Since seal collar 21 abuts box thread connector 13, the spring washers are compressed between seal collar 21 and load collar 23, thus tending to react against and dampen (or absorb) the axial force acting on pin connector 6 in the uphole direction. Additionally, when spring bank 25 includes the spring washers 26 being immersed in a hydraulic fluid, there is the further hydraulic dampening effect described above.

Figure 6:
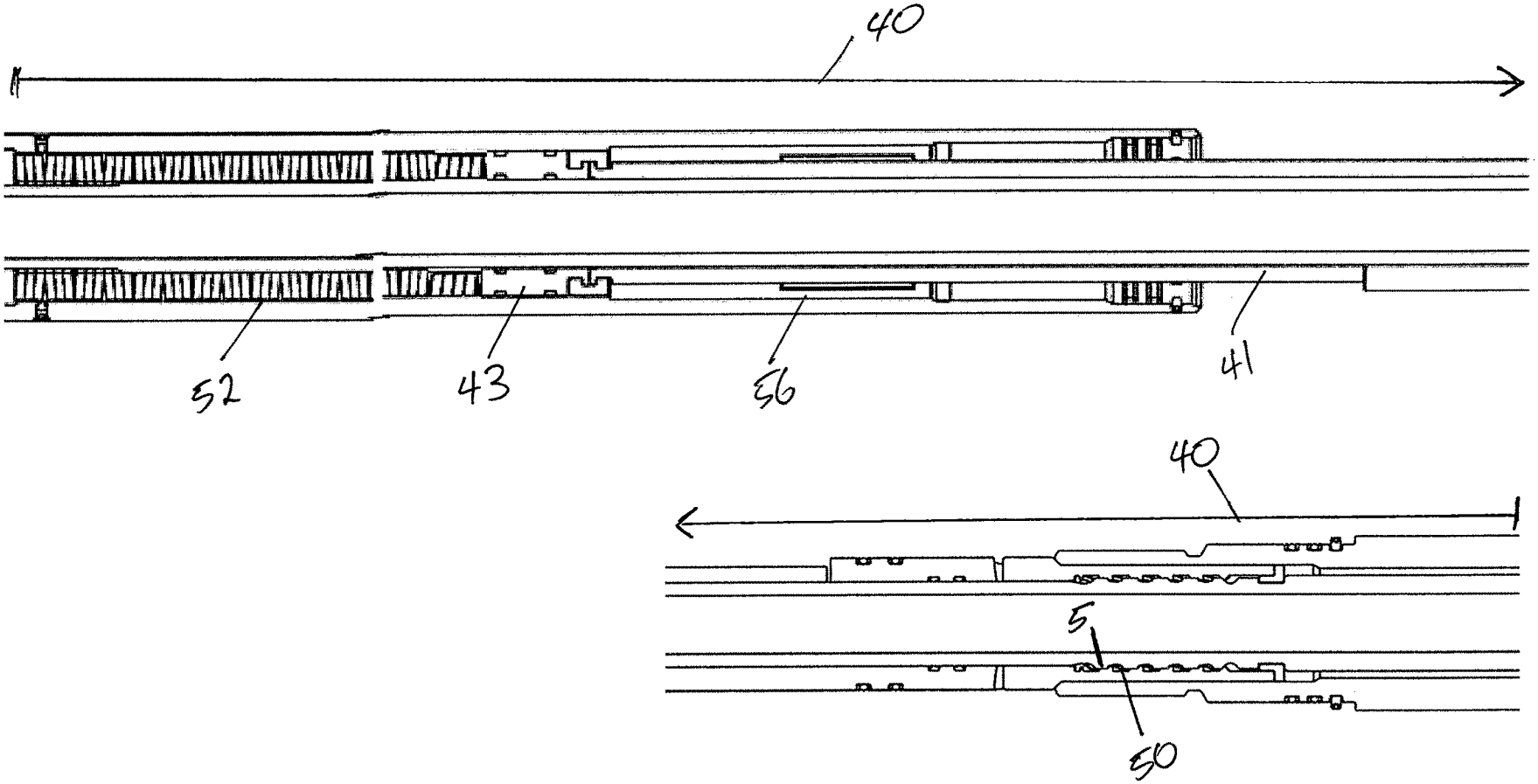
FIG. 6 is a cross-section particularly showing the torsional shock absorbing assembly.
Figure 7:
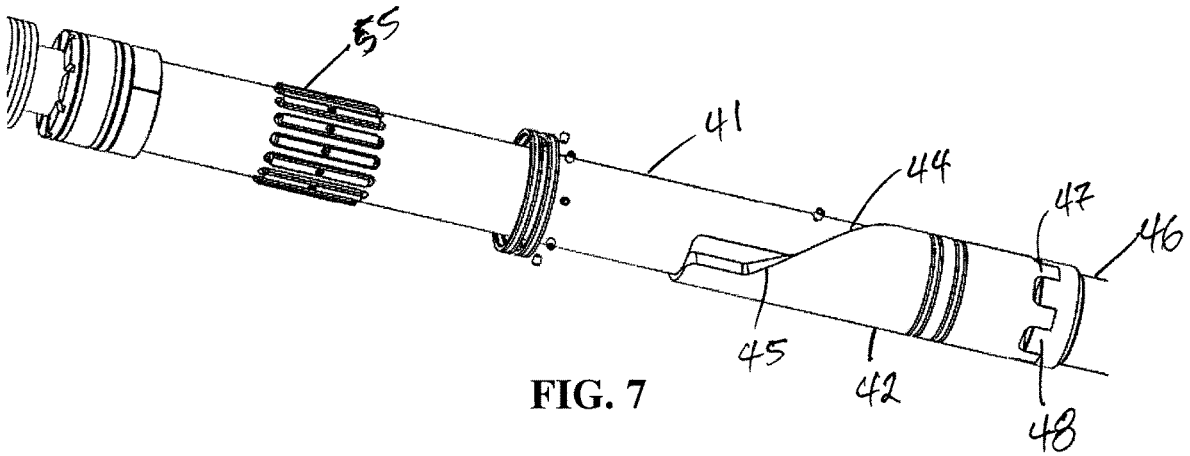
FIG. 7 is a perspective view of the helix sleeves of the torsional shock absorbing assembly.
Figure 8A:
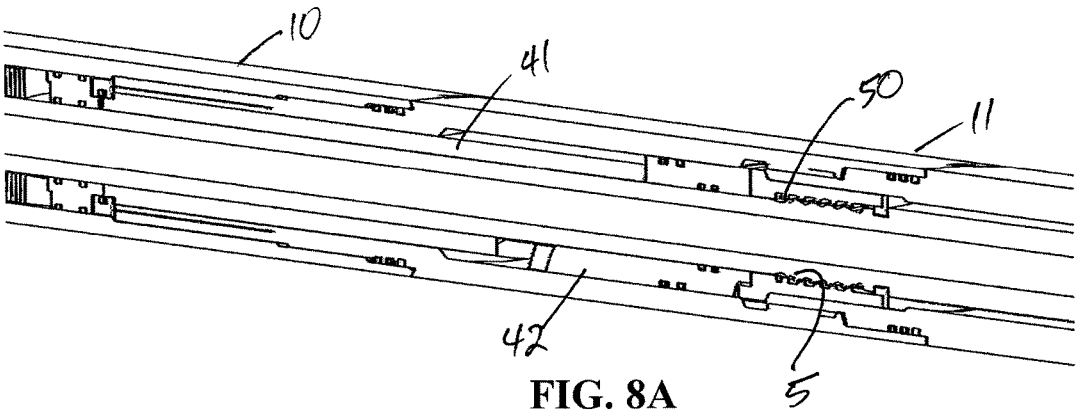
FIG. 8A is a perspective sectional view of the helix sleeves seen in FIG. 7.
Figure 8B:
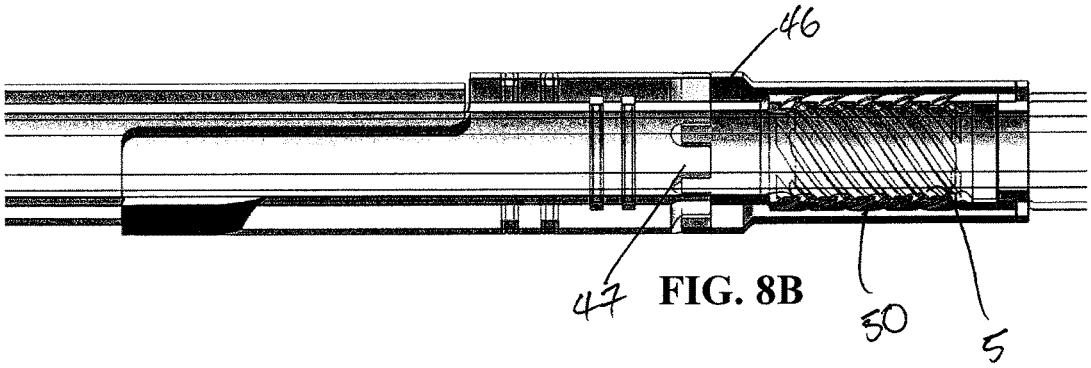
FIG. 8B is a side view of the helix sleeves seen in FIG. 7.

FIGS. 6-8 illustrate one embodiment of the torsional shock absorber assembly 40. As perhaps best seen in FIGS. 7 to 8B, shock absorber assembly 40 is generally formed of torsion transfer sleeve 46, lower helix sleeve 42, and upper helix sleeve 41. As suggested in FIGS. 8A and 8B, torsion transfer sleeve 46 will have a series of helical splines and grooves 50 which engage torsion (or helical) splines and grooves 5 on main stem 3. Depending on the relative lengths of the helical splines and grooves 5 and 50, the use of these splines and grooves allows some initial free movement between main stem 3 and torsion transfer sleeve 46. However, once the spline and grooves 5 "bottom out" in the spline and grooves 50, any further torsion in main stem 3 is fully transferred to torsion transfer sleeve 46. Torsion transfer sleeve 46 also includes a series of crenulations 48 which engage a mating set of crenulations 47 formed on lower helix sleeve 42. As best seen in FIG. 7, lower helix sleeve 42 further includes lower helix cam surface 45 which engages upper helix cam surface 44 on upper helix sleeve 41. Opposite the upper helix cam surface 44, a series of elongated (in the axial direction) anti-rotation splines 55 extend from the surface of upper helix sleeve 41. The anti-rotation splines 55 will engage corresponding grooves 56 (see FIG. 6) formed on the inside surface of torsion dampening sleeve 11 and prevent relative rotation between upper helix sleeve 41 and main sleeve 10, while allowing translation in the axial direction.

In operation, torsional force applied to the main stem 3 is transferred to torsion transfer sleeve 46 via the interlocking of torsion spline and grooves 5 and 50 on the main stem and torsion transfer sleeve, respectively. Through crenulations 48 and 47, this torque is transferred to lower helix sleeve 42. As lower helix sleeve 42 is urged to rotate, lower helix cam surface 45 will act on upper helix cam surface 44, thereby moving upper helix sleeve 41 axially in the uphole direction. As indicated above, anti-rotation splines 55 resist any rotation of upper helix sleeve 41 while allowing the axial movement. FIG. 6 shows how the upper helix sleeve 41 engages the torsion spring bank 52 (through the flow restrictor collar 43). In this manner, torque acting on the pin threads connector 6 is converted to axial movement of upper helix sleeve 41, which is dampened by the torsional spring bank 52. Additionally, similar to seal collars 21 and 22 discussed above, flow restrictor collar 43 may have bleed apertures formed through its interior which allows for the restricted transfer of hydraulic fluid across the collar. As with seal collars 21 and 22, this can provide a hydraulic dampening effect in addition to the mechanical dampening of the spring bank 52.

Although the embodiment seen in FIG. 7 shows only one pair of helix cam surfaces, and therefore can only dampen torsion in one rotational direction, other embodiments could include a second pair of helix cam surfaces (on the opposite side of the tool seen in FIG. 7), thereby allowing the helix sleeves to dampen torsion in both rotational directions. Another alternative embodiment could have the spline and grooves 5 on the main stem 3 being substantially longer than the corresponding spline and grooves 50 on the torsion transfer sleeve 46. The spline and grooves 50 would be positioned in the approximate center of the spline and grooves 5. This embodiment would not require the lower and upper helix sleeves, but rather torsion transfer sleeve 46 would extend into contact with flow restrictor collar 43. Rotation of the main stem 3 would tend to move the torsion transfer sleeve axially in a direction toward flow restrictor collar 43, thereby allowing spring bank 52 to dampen the torsional force being transmitted by main stem 3.

FIGS. 9-12 illustrate one embodiment of the lateral shock absorber assembly 70. Viewing FIGS. 10 and 11, the lateral shock absorber assembly 70 generally comprises the lateral activator ring 75 positioned around main stem 3, bracketed by two reaction collars 85, which are in turn bracketed by spring banks 92. As perhaps most easily seen in the exploded view of FIG. 12, the activator ring 75 includes a series of outer wedge pockets 76 and inner wedge pockets 77 alternately spaced around the perimeter of activator ring 75. A series of screw apertures 78 will be formed in both the outer and inner wedge pockets. The outer wedge inserts 81 will include two wedge inclined surfaces 83 separated by a mounting recess 84. The mounting recesses will be secured in the activator ring outer wedge pockets 76 with screws 82 (see FIG. 11). The inner wedge inserts 80 similarly include wedge inclined surfaces 83 and mounting recesses 84 to allow their attachment to the activator ring inner wedge pockets 77.

Figure 10:
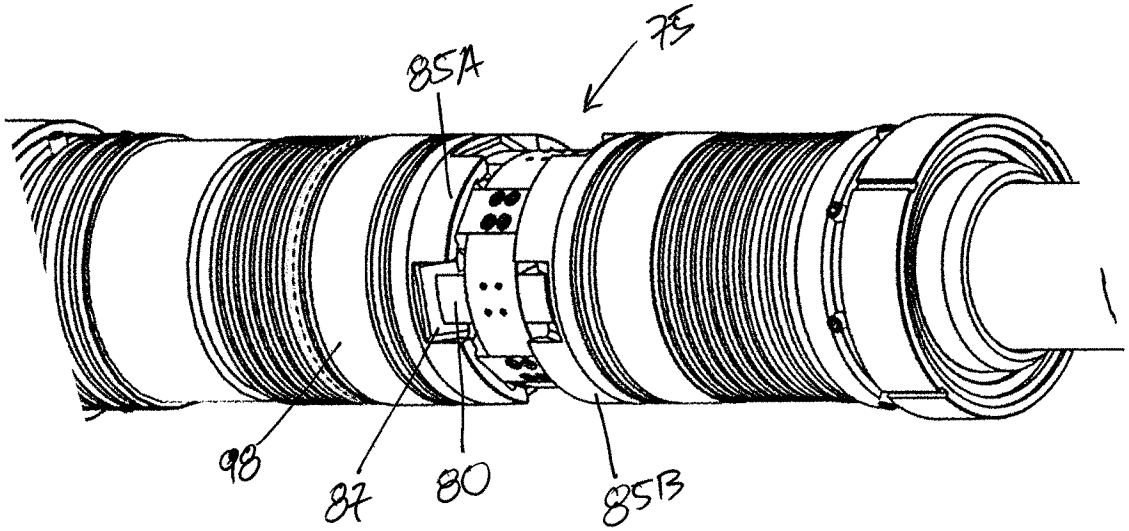
FIG. 10 is a perspective view of the lateral shock absorbing assembly with the outer housing remove.
Figure 11:
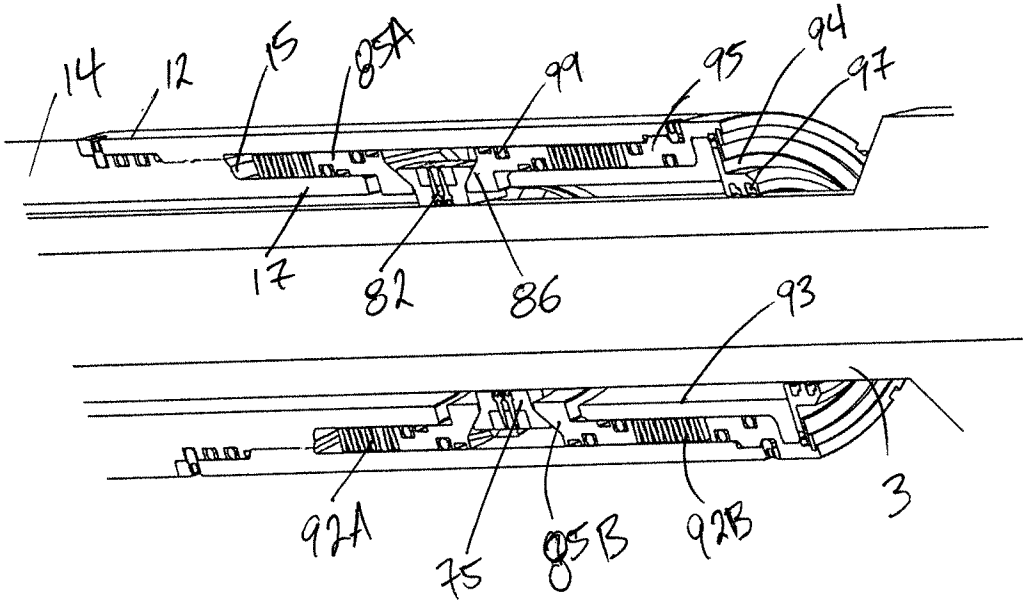
FIG. 11 is a sectioned view of the lateral shock absorbing assembly of FIG. 10.
Figure 12:
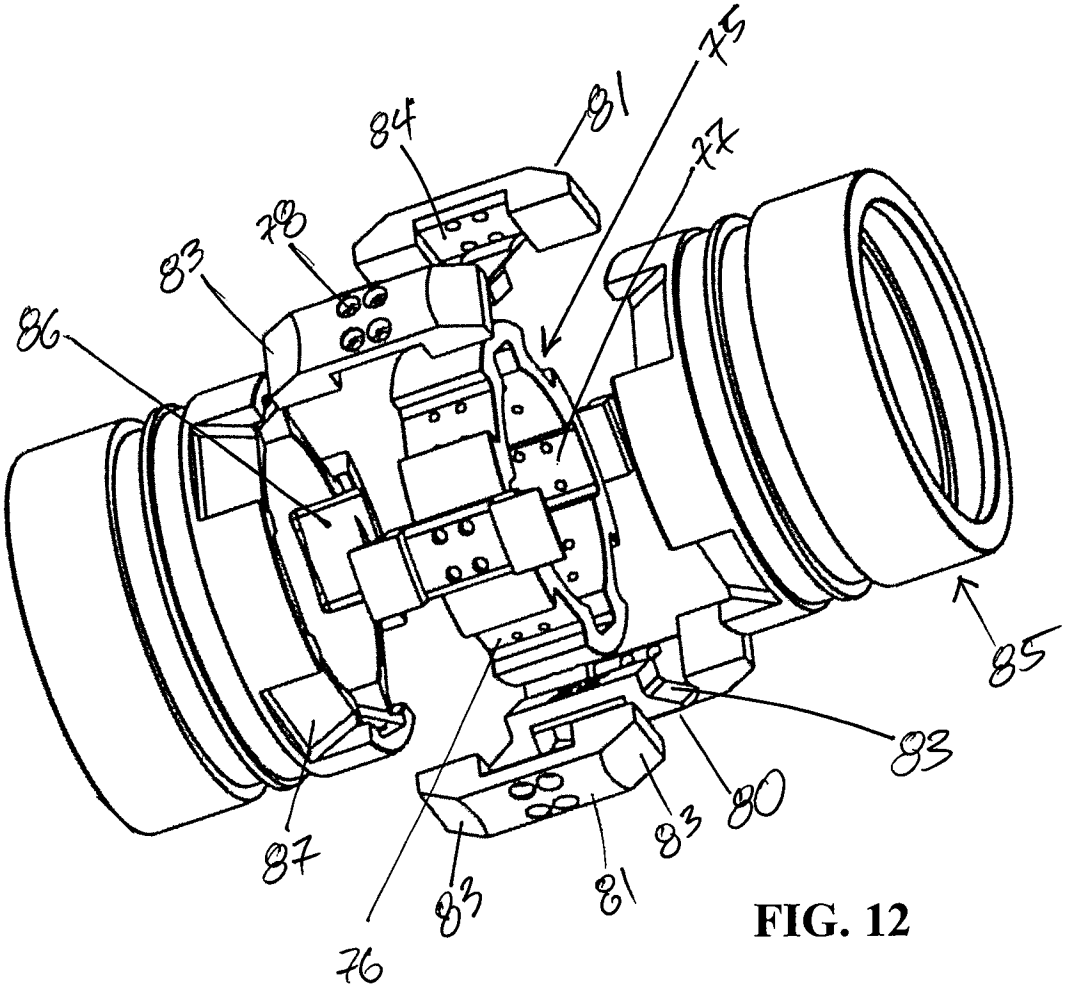
FIG. 12 is an exploded view of the activator ring and reaction collars of the lateral shock absorbing assembly.

The reaction collars 85 will include both inner ramp surfaces 86 and outer ramp surfaces 87 positioned around the circumference of the reaction collars. In the assembled state as seen in FIGS. 10 and 11, the wedge inclined surfaces of inner wedge inserts 80 will engage the outer ramp surfaces 87 of the reaction collars 85, while the wedge inclined surfaces of the outer wedge inserts 81 will engage the inner ramp surfaces 86 of the reaction collars 85. As best seen in FIG. 11, the upper spring bank 92A and reaction collar 85A rests on the shelf portion 17 of lower spacing sleeve 14, with spring bank 92A abutting against shoulder 15 (of lower spacing sleeve 14). The lower spring bank 92B and reaction collar 85B rest on spring collar 93 with spring bank 92B abutting against the seal carrier 95. Viewing FIG. 9, the end retainer is fixed in lateral dampening sleeve 12 with snap ring 96. The planar portion of the inner and outer wedge inserts 80 and 81 will be positioned circumferentially around and resting against the surface of main stem 3.

It can be seen from FIGS. 10 and 11 how lateral movement of the pin threads connector 6 transmits force to the inner and outer wedge inserts 80 and 81 positioned along the axis of that lateral movement. The inclined surfaces of the wedge inserts transmit axial force to the corresponding inner and outer ramp surfaces 86 and 87 of the reaction collars 85. This axial force on the reaction collars 85 is then resisted and dampened by the spring banks 92. Typically, lateral movement of main stem 3 in a particular direction will only compress one of the spring banks 92, while lateral movement in the opposite direction compresses the other spring bank 92. In certain embodiments, the components of lateral shock absorber assembly 70 rest in a bath of hydraulic dampening fluid. When one of the spring banks 92 is compressed, dampening fluid tends to be displaced toward the opposite spring bank 92, again providing some additional hydraulic dampening effect.

Figure 14:
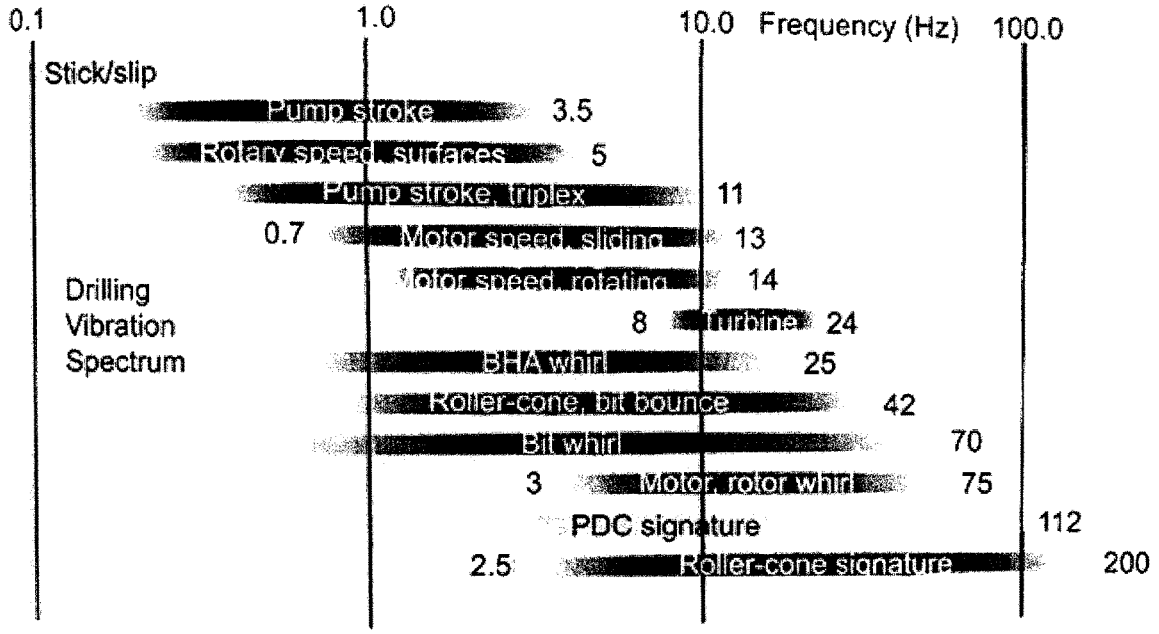
FIG. 14 is a chart of different vibration sources and frequencies.

Those skilled in the art recognize that the various drilling processes have an approximately known vibration spectrum. This means that most of the frequencies encountered downhole during drilling can be attributed to various components (e.g., tools, bit-rock interaction, operational parameters, BHA configuration, wellbore contact points, mud type, etc.). The vibration frequency range of many common drilling tools and operations are discussed in publications such as Macpherson, Mason, & Kingman, *Surface Measurement and Analysis of Drillstring Vibrations While Drilling*, SPE-25777-MS, SPE/IADC Drilling Conference, Amsterdam, NL, Feb. 22-25, 1993, which is incorporated by reference herein. FIG. 14 illustrates certain example drilling vibration frequency spectral signatures. By properly selecting the spring constants and arranging the springs in the spring banks, the shock absorbing sub can be tailored to dampen vibrations of a certain level/tool/type. The shock absorbing sub will be designed to dampen excitation frequencies up to and past the natural frequency of the system being dampened. For example, if the primary function of the shock absorbing sub is to dampen a PDC response (up to 112 Hz torsional frequency), the torsional spring bank could be designed with a resonant frequency higher than 112, say 130 Hz.

In certain embodiments, the axial spring bank 25, the torsional spring bank 52, and the lateral spring banks 92 could generally have the same spring constant and the same linear frequency response. However, in many embodiments, it will be advantageous for the different spring banks to have different spring constants and different frequency responses (either linear or nonlinear), i.e., different spring banks may have frequency responses in different frequency bands. In one example embodiment, the axial spring bank 25 is configured to have a frequency response of between 1 and 4 Hz (or any subrange in between), the lateral spring banks 92 is configured to have a frequency response between 1 and 75 Hz (or any subrange in between), and the torsional spring bank 52 is configured to have a frequency response of between 15 and 150 Hz (or any subrange in between). In many embodiments, the desired frequency response of the spring bank will be obtained by adjusting the rigidity or the spring constant of the spring bank, i.e., a spring bank having a higher spring constant will have a higher frequency response. Those skilled in the art will also recognize that the frequency response will vary depending on the overall mass of the system (i.e., tool) in which the spring bank is positioned. Thus, making the tool shorter, using heavier or lighter materials in other sub-assemblies outside the spring banks, or different hydraulic fluid density, will change the resonant frequency of the tool.

Figure 4B:
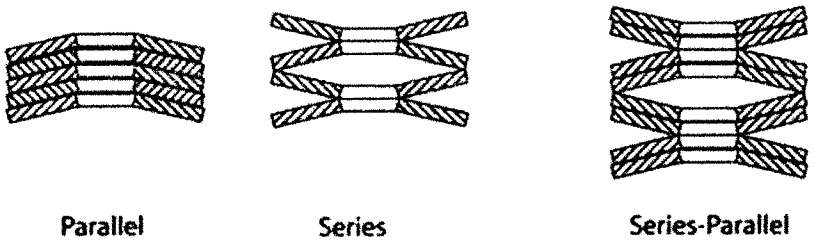
FIG. 4B is an illustration of different spring washer configurations.

In one example, the axial spring bank 25 may be configured to have a spring constant of between 5,000 and 30,000 lbs/in (or any subrange in between), the lateral spring banks 92 may be configured to have a spring constant of between 1,000 and 5,000 lbs/in (or any subrange in between), and the torsional spring bank 52 may be configured to have a spring constant of between 5,000 and 60,000 lbs/in (or any subrange in between). The spring banks may be constructed in a manner where the spring constant is substantially linear, i.e., each unit of displacement results in the same reaction force from the spring bank. In the case of a spring bank formed of spring washers, the individual spring washers would all have the same spring constant and be oriented in the same way, e.g., all spring washers aligned in a "parallel" stack, a "series" stack, or a "series-parallel" stack as suggested in FIG. 4B.

In other embodiments, the spring banks may be constructed in a manner where the spring constant (across the entire spring bank) is substantially nonlinear. In one example, this nonlinearity may be accomplished by forming the spring bank in multiple sections with the sections having different spring constants. FIG. 4A suggests how spring bank 25 can be divided up into three spring bank sections 27A, 27B, and 27C. The spring constant of the individual spring bank sections 27 may be controlled in different manners. In one example, spring washers of different materials (having different spring constants) may be used to construct the different spring bank sections. In another example, the orientation of the spring washers (e.g., parallel, series, series-parallel) may be varied between the different sections in order to control the spring constant in that section. In one particular embodiment, the spring bank section 27A would have a spring constant of 1000 to 5000 lbs/in, spring bank section 27B 5000 to 10,000 lbs/in, and 27C 10,000 to 15,000 lbs/in. More generally, the nonlinear response spring banks can be divided into two or more spring bank sections, with each spring bank section having a different spring constant somewhere between 1000 and 30,000 lbs/in (or any subrange in between). The dampening fluid will typically be a hydraulic oil, such as International Standards Organization Viscosity Grade (ISO VG) 68 for the bleed aperture size and number described herein. Naturally, other viscosity grades could be employed given different bleed apertures and desired dampening effect, including as a nonlimiting examples, 32, 46, 100, etc.

Although the illustrated embodiments disclose spring washers forming the axial, torsional, and lateral spring banks, other biasing mechanisms could be employed. For example, the axial spring bank could be replaced with one or more compression HELI-CAL Machined Springs® available from MW Industries, Inc. of Santa Maria, California. Similarly, the entire torsional absorber assembly 40 and lateral absorber assembly 70 could be formed with torsional and lateral HELI-CAL Machined Spring, respectively.

Figure 13A:
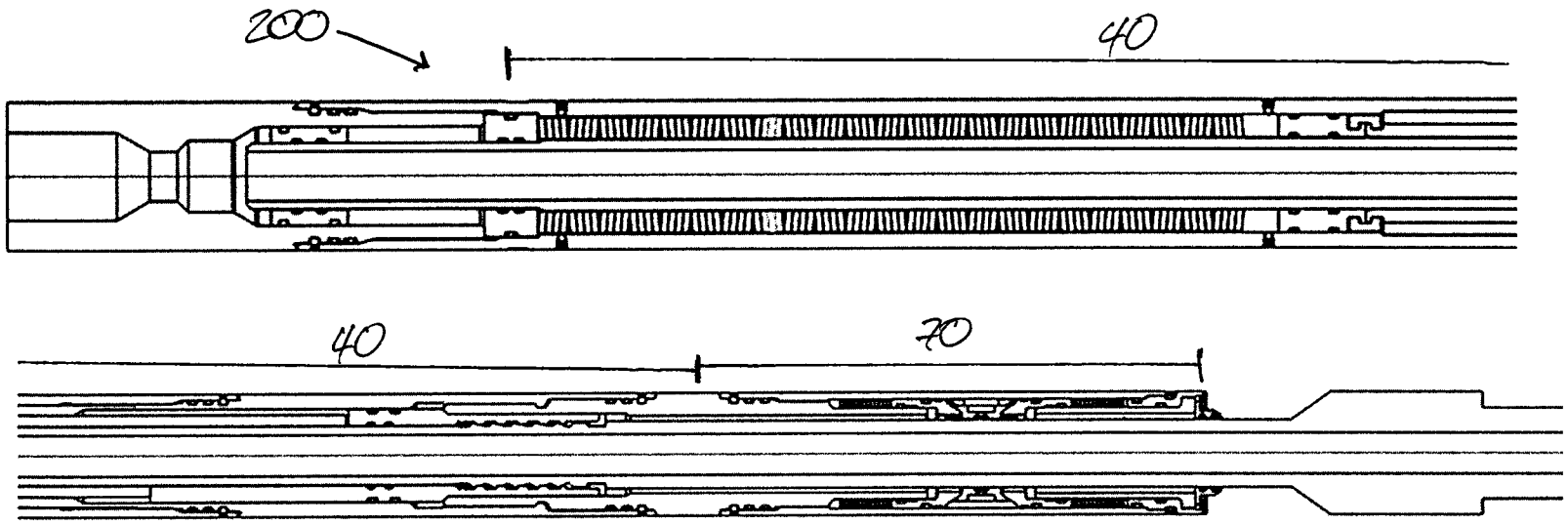
FIG. 13A is a cross-sectional view of an alternative lateral/torsional shock absorber sub.
Figure 13B:
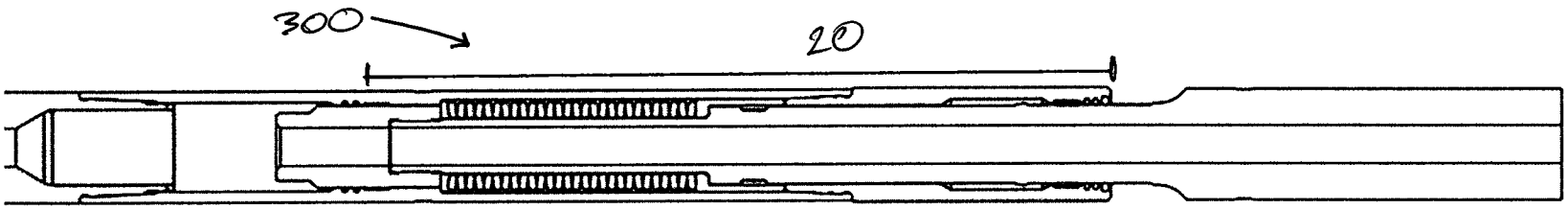
FIG. 13B is a cross-sectional view of an alternative axial shock absorber sub.

FIGS. 13A and 13B illustrate another modification of the above described invention. FIG. 13A shows a bi-axial shock absorbing sub 200. This sub 200 includes only a torsional absorber assembly 40 and a lateral absorber assembly 70 having the same structure as described previously. To dampen axial forces, the sub 200 in FIG. 13A will be connected to second sub 300 having only the axial absorber assembly 20 such as seen in FIG. 13B.

The invention claimed is:

1. A downhole multi-axis shock absorbing sub comprising:

(a) a tubular main stem extending through a sub housing;

(b) a lateral shock absorbing assembly positioned within the sub housing and comprising:

(i) an activator ring positioned around the main stem, the activator ring including a plurality of wedge inserts positioned around a perimeter of the activator ring;

(ii) a reaction collar positioned on each side of the activator ring, the reaction collars including ramp surfaces engaged by the wedge inserts;

(iii) a spring system positioned to resist movement of the reaction collars away from the activator ring; and (c) whereby lateral movement of the main stem causes the wedge inserts to move the reaction collars against the spring system.

2. The multi-axis shock absorbing sub of claim 1, wherein the spring system is a bank of spring washers.

3. The multi-axis shock absorbing sub of claim 2, further comprising a separate bank of spring washers engaging each reaction collar.

4. The multi-axis shock absorbing sub of claim 1, wherein the wedge inserts are alternately positioned on an inner surface and outer surface of the activator ring.

5. The multi-axis shock absorbing sub of claim 4, wherein the ramp surfaces are alternately positioned on an inside surface and an outside surface of the reaction collar.

6. The multi-axis shock absorbing sub of claim 5, wherein wedge inserts on the inner surface of the activator ring engage ramp surfaces on the outside surface of the reaction collars and wedge inserts on the outer surface of the activator ring engage ramp surfaces on the inside surface of the reaction collars.

7. The multi-axis shock absorbing sub of claim 1, wherein (i) the wedge inserts have opposing inclined surfaces separated by a mounting recess, and (ii) the mounting recesses of the wedge inserts engage wedge pockets on the activator ring.

8. The multi-axis shock absorbing sub of claim 1, further comprising:

(d) a torsional shock absorbing assembly positioned within the sub housing and comprising:

(i) a first helix sleeve configured to rotate with the main stem, the first helix sleeve having a first helical cam surface formed on an end surface of the sleeve;

(ii) a second helix sleeve configured to translate relative to the main stem, the second helix sleeve having a second helical cam surface formed on an end surface of the sleeve and engaging the first helical cam surface;

(iii) a spring system positioned to resist movement of the first and second helix sleeves away from one another; and (e) whereby rotational movement of the main stem causes the first and second helical cam surfaces to move (i) the first and second helix sleeves apart, and (ii) at least one of the first or second helix sleeves into engagement with the spring system.

9. The multi-axis shock absorbing sub of claim 8, wherein the spring system of the torsional shock absorbing assembly and the spring system of the lateral shock absorbing assembly both have a nonlinear spring constant.

10. The multi-axis shock absorbing sub of claim 9, wherein the spring system of the torsional shock absorbing assembly and the spring system of the lateral shock absorbing assembly have responses in different frequency bands.

11. The multi-axis shock absorbing sub of claim 10, wherein the spring system of the torsional shock absorbing assembly is in the 15 to 150 Hz frequency band and the spring system of the lateral shock absorbing assembly is in the 1 to 75 Hz frequency band.

12. The multi-axis shock absorbing sub of claim 8, wherein the spring system of the torsional shock absorbing assembly and the spring system of the lateral shock absorbing assembly both have a first spring section with a spring constant between 1,000 and 5,000 lbs/in and a second spring section with a spring constant between 5,000 and 10,000 lbs/in.

13. The multi-axis shock absorbing sub of claim 12, wherein the spring system of the torsional shock absorbing assembly and the spring system of the lateral shock absorbing assembly both have a third spring section with a spring constant between 10,000 and 15,000 lbs/in.

14. The multi-axis shock absorbing sub of claim 1, further comprising an axial shock absorbing assembly positioned on the tubular main stem.

15. A downhole shock absorbing sub comprising:

(a) a tubular main stem extending through a sub housing;

(b) a lateral shock absorbing assembly positioned within the sub housing and comprising:

(i) an activator ring positioned around the main stem;

(ii) a reaction collar positioned on each side of the activator ring;

(iii) a plurality of wedge inserts and corresponding ramp surfaces acting between the activator ring and the reaction collars;

(iv) a spring system positioned to resist movement of the reaction collars away from the activator ring; and (c) whereby lateral movement of the main stem causes interaction between the wedge inserts and ramp surfaces to move the reaction collars against the spring system.

16. The shock absorbing sub of claim 15, wherein the wedge inserts are positioned around a perimeter of the activator ring and the ramp surfaces are positioned on the reaction collars.

17. The shock absorbing sub of claim 15, further comprising a torsional shock absorbing assembly positioned within the sub housing, wherein rotational movement of the main stem causes at least one sleeve with a helical cam surface to move into engagement with the spring system.

* * * * *